US012629578B2

(12) United States Patent
Reneaum

(10) Patent No.: US 12,629,578 B2
(45) Date of Patent: May 19, 2026

(54) GOLF SWING TRAINING DEVICE

(71) Applicant: Armando Reneaum, Calexico (MX)

(72) Inventor: Armando Reneaum, Calexico (MX)

( * ) Notice: Subject to any disclaimer, the term of this patent is extended or adjusted under 35 U.S.C. 154(b) by 0 days.

(21) Appl. No.: 19/332,218

(22) Filed: Sep. 18, 2025

(65) Prior Publication Data

US 2026/0077257 A1 Mar. 19, 2026

Related U.S. Application Data

(60) Provisional application No. 63/696,114, filed on Sep. 18, 2024.

(51) Int. Cl.
*A63B 69/36* (2006.01)
*A63B 57/15* (2015.01)

(52) U.S. Cl.
CPC ..... *A63B 69/3658* (2013.01); *A63B 57/15* (2015.10); *A63B 2220/30* (2013.01); *A63B 2220/803* (2013.01)

(58) Field of Classification Search
CPC . A63B 69/3658; A63B 57/15; A63B 2220/30; A63B 2220/803
See application file for complete search history.

(56) References Cited

U.S. PATENT DOCUMENTS 4,713,686 A * 12/1987 Ozaki ..... A63B 69/3658 396/173
2008/0151548 A1* 6/2008 Desfosses ..... F21V 14/08 362/322
2011/0237340 A1* 9/2011 Hill ..... A63B 69/3623 473/218
2023/0356047 A1* 11/2023 Kreppein ..... A63B 71/04

FOREIGN PATENT DOCUMENTS

JP H0634672 U * 5/1994
JP 2003507150 A * 2/2003 ..... G01P 3/40
WO WO-2024232645 A1 * 11/2024 ..... A63B 71/04

OTHER PUBLICATIONS

JP 2003507150 A Translation (Year: 2003).*
JP H0634672 U Translation (Year: 1994).*
WO 2024232645 A1Translation (Year: 2024).*

* cited by examiner

*Primary Examiner* — Jeffrey S Vanderveen
(74) *Attorney, Agent, or Firm* — Eric Hanscom

(57) ABSTRACT

A golf training aid has a hitting portion, a standing portion, and a light unit. The hitting portion has a step, adjustable tees and rails. The standing portion has standing pad alignment lines and golf ball direction options. The light unit senses when a golf club is about to strike a golf ball and this triggers a variety of speed sensors, fast and slow strobe lights and other feedback devices that give the golfer immediate feedback on his/her swing, without the golfer having to a) wait for feedback, and b) take his/her eyes off the ball.

16 Claims, 21 Drawing Sheets

GOLF SWING TRAINING DEVICE

CROSS REFERENCE TO RELATED APPLICATIONS

This application claims priority back to U.S. Provisional Application No. 63/696,114, filed Sep. 18, 2024, the contents of which are incorporated by reference.

STATEMENT REGARDING FEDERALLY SPONSORED RESEARCH OR DEVELOPMENT

This invention was not federally sponsored.

FIELD OF THE INVENTION

The present disclosure relates generally to the field of devices to improve a person's golf game and more specifically, to a device that measures a person's golf swing and gives immediate visual and performance feedback both as to the distance the golf ball will travel and to the direction it will go. The invention is designed to help golfers focus on hitting the ball squarely and to accurately gauge the distance a ball will travel when hit with a certain speed of golf swing with a specific golf club.

In short: the invention is the golfer's ultimate training partner. It combines instant visualization, enhanced concentration, and the ability to practice in distraction-free environments, giving them the fastest route to swing improvement.

BACKGROUND

Problem Stated. Improving a golfer's golf game has been a challenge ever since the first modern version of golf was developed somewhere in Scotland during the Middle Ages. Comics such as Robin Williams can humorously describe the difficulties in hitting a small, hard ball with an angled piece of metal or wood, and hope that the ball travels in the proper direction and with the proper distance to eventually end up in the hole. However, as many golfers will attest to, trying to improve your golf game is not always fun and games.

Golfers spend upwards of $25,000,000,000 per year on golfing equipment, and in 2023 it was estimated that golfers spent $380,000,000 just on golf training aids, so golfing is a big business. Thus, a successful product that helps to improve a golfer's golf experience can be a significant business opportunity.

Currently, there are a number of training aids for golfers, however, the industry is lacking in training aids that use strobe lights, motion detectors and speed meters to not only estimate the flight path and distance of a particular swing, but also uses visual aids to show golfers the angle of their clubs when they strike the ball.

Many golfers try to improve their golf game by hitting a golf ball at home against a net. To evaluate the swing, the player must lift their eyes from the ball an instant before impact to see where the ball hits the net. This small movement, however, directly contradicts one of the golden rules of a good swing: keeping your eyes on the point of impact until the swing is fully completed.

The current invention provides just such a solution for a long-felt need by providing a three-part training aid with a two-level hitting pad with an adjustable tee, for chipping and driving, a standing pad with foot placement guides, and a movement detection system. The user selects a golf club that triggers a strobe light (optionally blacklight) that is activated by a motion detector. The strobe light flashes when the head of a golf club passes underneath it, giving the golfer a clear image of the club face's position. A speed meter measures the speed of the golf club head. Data from the speed meter is sent to a calculator, which can be programmed to specific golf clubs which estimates the distance a golf ball would be hit on a golf course.

SUMMARY OF THE INVENTION

This summary is provided to introduce concepts related to the golf swing training aid described in this application. The concepts are further described below in the detailed description. This summary is not intended to identify key features or essential features of the claimed subject matter, nor is it intended to be used to limit the scope of the claimed subject matter.

The present disclosure relates to a Golf Swing Training Device. The invention is an innovative tool designed to enhance a golfer's swing by providing immediate visual and performance feedback. The device includes several key components:

A Movement Detection System: The device features a unique, arch-shaped frame positioned to allow the head of a golf club to pass underneath it during a swing. As the club head moves through the swing, it triggers a highly sensitive movement detector that activates an integrated strobe light.

Strobe Light Feedback: The strobe light emits a rapid flash at the precise moment the club face reaches the ball's impact point. This flash provides the user with a clear, instantaneous image of the club face's position, allowing for immediate assessment and adjustment of swing technique.

Speed Measurement and Distance Calculation: Embedded within the device is a speed meter that measures the club head speed as it passes beneath the frame. The captured speed data is sent to an onboard calculator, which has been pre-programmed with specific details of the golf club being used. This information is used to calculate the estimated carry distance of the ball, which is then displayed instantly on a digital screen. Information on the results of each swing can be saved and downloaded to a cell phone, computer, or other device so that the user's progress can be recorded and followed. This can be done both by the user and, in the case of training centers, by the golf pro giving instruction to the golfer.

Two-Part Hitting Pad: The device includes a specialized hitting pad with two distinct levels: 1. Standing Pad: A level surface for the user to stand on, ensuring stability and comfort during the swing. 2. Hitting Surface: Adjacent to the standing pad, this surface is divided into two sections, first, a Level Section: At the same height as the standing pad, it is marked with reference lines to help users evaluate their swing path and alignment. Second, a Lowered Ball Placement Area: A lower section where the golf ball is positioned. This design enables a downward swing trajectory, reducing the risk of hitting the surface and preventing potential injury to the user's arms.

By combining immediate visual feedback, precise speed measurement, and accurate distance calculation, the Golf Swing Training Device offers a comprehensive solution for golfers looking to improve their swing mechanics and overall performance.

In an embodiment, the invention has a strobe light on a flexible arm.

In an embodiment, the invention has two strobe lights

In an embodiment, the frame has a flexible joint.

In an embodiment, the support arm of the frame can be raised or lowered.

By way of summary, the quality of any golf swing can be determined by two main factors: 1) the trajectory of the clubhead as it approaches the ball, and 2) the exact position of the clubface at the moment of impact. Many golfers rely on a "home setup, which has them hit a ball off a tee into a net. To evaluate the swing, the player must lift their eyes from the ball an instant before impact to see where the ball hits the net. This small movement, however, directly contradicts one of the golden rules of a good swing: keeping their eyes on the point of impact until the swing is fully completed.

The current invention for which this utility patent is being filed is unique in that it is the only device on the market that delivers instant visualization directly to the golfer's eyes at the precise moment when the clubface makes contact with the ball. This breakthrough allows golfers to see—in real time—the most important information they need for improvement, without breaking concentration or moving their eyes away from the ball. This allows golfers to quickly improve their golf game through providing immediate muscle memory feedback. By seeing the result of their swing at the exact moment of impact, golfers access their muscle memory while it's still "alive." This makes it far easier to recognize what part of a golfer's swing was executed correctly, and what needs adjustment—allowing the golfer to make corrections in the very next swing.

A successful golf swing requires the coordination of multiple technical details: grip, stance, backswing, downswing, impact, and follow-through. Concentration is crucial. The current invention keeps distractions to a minimum by letting a golfer focus entirely on execution, not on chasing the ball into a net.

A second advantage of this invention is that it enhances training due to the reduced lighting conditions. This low-light environment naturally minimizes surrounding distractions, helping the player concentrate on their movement. The invention is fully compatible with low-light practice: the light-based reflection display becomes even sharper and more effective in darker conditions, making the feedback more intense and easier to process.

To quickly summarize the advantage of the invention, 1) there is i Instant feedback on clubface position at impact, 2) the visualization works with muscle memory in real time, it encourages proper swing discipline (eyes stay on the ball), and 4) it is compatible with low-light or black-light practice environments, where concentration is maximized.

This disclosure will now provide a more detailed and specific description that will refer to the accompanying drawings. The drawings and specific descriptions of the drawings, as well as any specific or alternative embodiments discussed, are intended to be read in conjunction with the entirety of this disclosure. The invention as described herein may, however, be embodied in many different forms and should not be construed as being limited to the embodiments set forth herein; rather, these embodiments are provided by way of illustration only and so that this disclosure will be thorough, complete and fully convey understanding to those skilled in the art.

BRIEF DESCRIPTION OF THE DRAWINGS

The illustrated embodiments of the subject matter will be best understood by reference to the drawings, wherein like parts are designated by like numerals throughout. The following description is intended only by way of example, and simply illustrates certain selected embodiments of devices, systems, and methods that are consistent with the subject matter as claimed herein, wherein:

Figure 1:
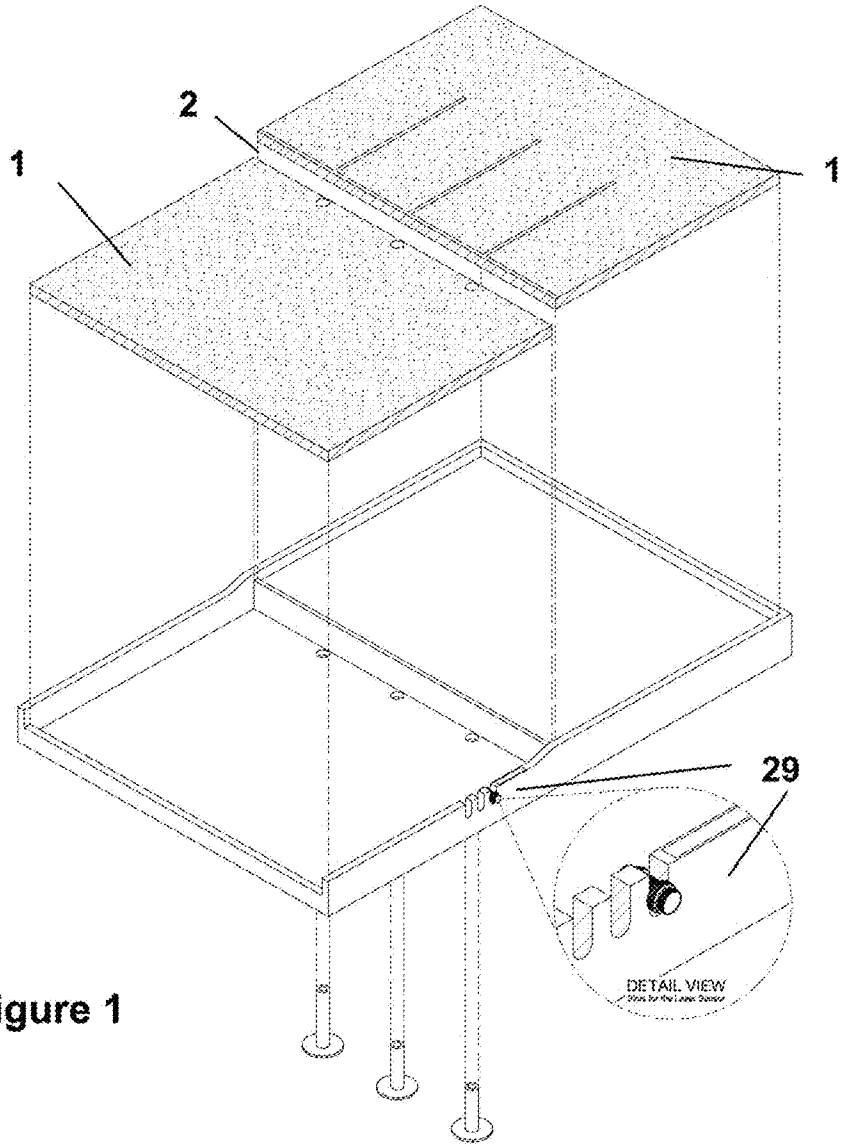
FIG. 1 is an exploded perspective view of the hitting pad portion of the invention.

The figures depict embodiments of the disclosure for purposes of illustration only. One skilled in the art will readily recognize from the following description that alternative embodiments of the structures and methods illustrated herein may be employed without departing from the principles of the disclosure described herein.

DETAILED DESCRIPTION

The detailed description of various exemplary embodiments of the disclosure is described herein with reference to the accompanying drawings. It should be noted that the embodiments are described herein in such details as to clearly communicate the disclosure. However, the amount of details provided herein is not intended to limit the anticipated variations of embodiments; on the contrary, the intention is to cover all modifications, equivalents, and alternatives falling within the spirit and scope of the present disclosure as defined by the appended claims.

It is also to be understood that various arrangements may be devised that, although not explicitly described or shown herein, embody the principles of the present disclosure. Moreover, all statements herein reciting principles, aspects, and embodiments of the present disclosure, as well as specific examples, are intended to encompass equivalents thereof.

The terminology used herein is for the purpose of describing particular embodiments only and is not intended to be limiting of example embodiments. As used herein, the singular forms "a", "an" and "the" are intended to include the plural forms as well, unless the context clearly indicates otherwise. It will be further understood that the terms "comprises", "comprising", "includes" and/or "including," when used herein, specify the presence of stated features, integers, steps, operations, elements and/or components, but do not preclude the presence or addition of one or more other features, integers, steps, operations, elements, components and/or groups thereof.

It should also be noted that in some alternative implementations, the functions/acts noted may occur out of the order noted in the figures. For example, two figures shown in succession may, in fact, be executed concurrently or may sometimes be executed in the reverse order, depending upon the functionality/acts involved.

Unless otherwise defined, all terms (including technical and scientific terms) used herein have the same meaning as commonly understood by one of ordinary skill in the art to which example embodiments belong. It will be further understood that terms, e.g., those defined in commonly used dictionaries, should be interpreted as having a meaning that is consistent with their meaning in the context of the relevant art and will not be interpreted in an idealized or overly formal sense unless expressly so defined herein.

As can be seen by the previous description of the prior art and the invention itself, It would be desirable to have a )(Abstract).

To this, the present disclosure advantageously fills the abovementioned needs and addresses the aforementioned deficiencies by providing a training device to improve a person's golf swing. As a brief summary, the training device has a hitting pad, a standing pad, and a movement detection system. The hitting pad has two levels for driving and chipping swings, and an adjustable tee to hold the golf ball. A golf club is used to trigger a strobe light as it is swung through the invention. The movement detection system has a motion detector that sends a signal to the strobe light, where the strobe light flashes when the head of a golf club passes underneath it, giving the golfer a clear image of the club face's position. A speed meter measures the speed of the golf club head. Data from the speed meter is sent to a calculator, which can be programmed to specific golf clubs which estimates the distance a golf ball would be hit on a golf course.

FIG. 1 is an exploded perspective view of the hitting pad portion of the invention. A hitting pad 1, has an upper level and a lower level, separated by the step 2. A locking device 29 joins the various parts.

Figure 2:
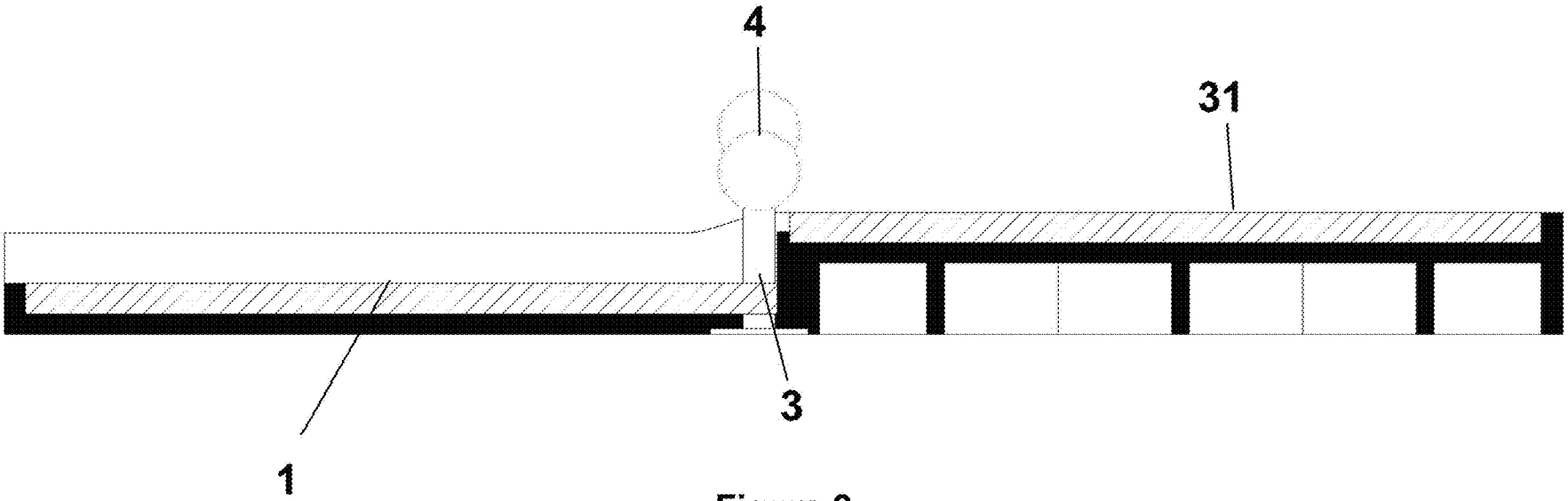
FIG. 2 is a side view of the hitting pad portion of the invention.

FIG. 2 is a side view of the hitting pad portion 1 of the invention. An upper section 31 stands above the rest of the hitting pad. A adjustable tee 3 holds a golf ball 4 ready to be hit.

Figure 3:
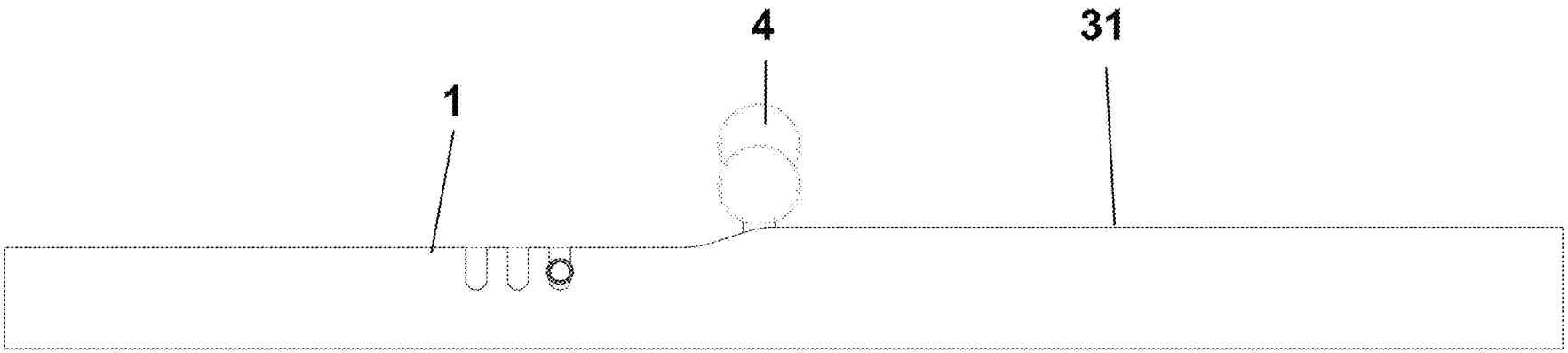
FIG. 3 is a side view of the hitting pad portion of the invention.

FIG. 3 is a side view of the hitting pad portion of the invention.

Figure 4:
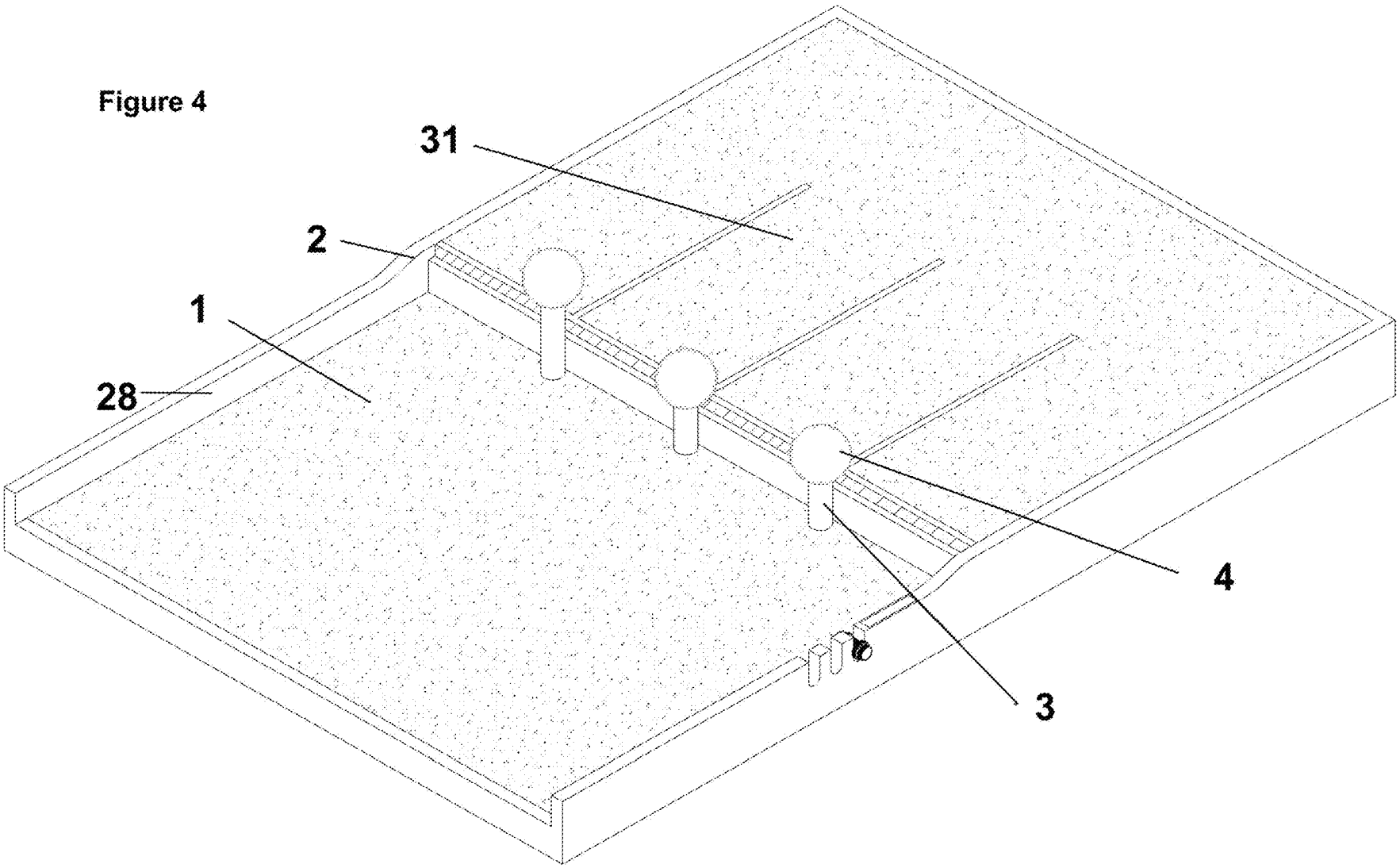
FIG. 4 is a perspective view of the is a side view of the hitting pad portion of the invention.

FIG. 4 is a perspective view of the is a side view of the hitting pad portion of the invention. Rails 28 are found on the sides and add strength to the structure as well as retailing golf balls 4.

Figure 5:
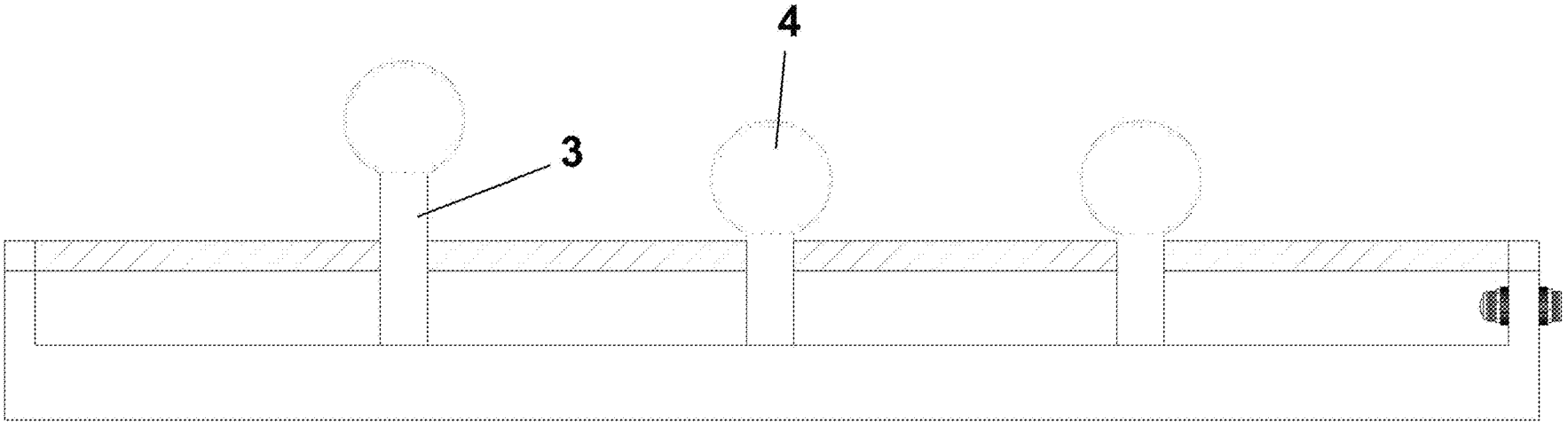
FIG. 5 is a side view of the hitting pad portion of the invention.

FIG. 5 is a side view of the hitting pad portion of the invention showing the adjustable tees 3 and location of the golf ball 4.

Figure 6:
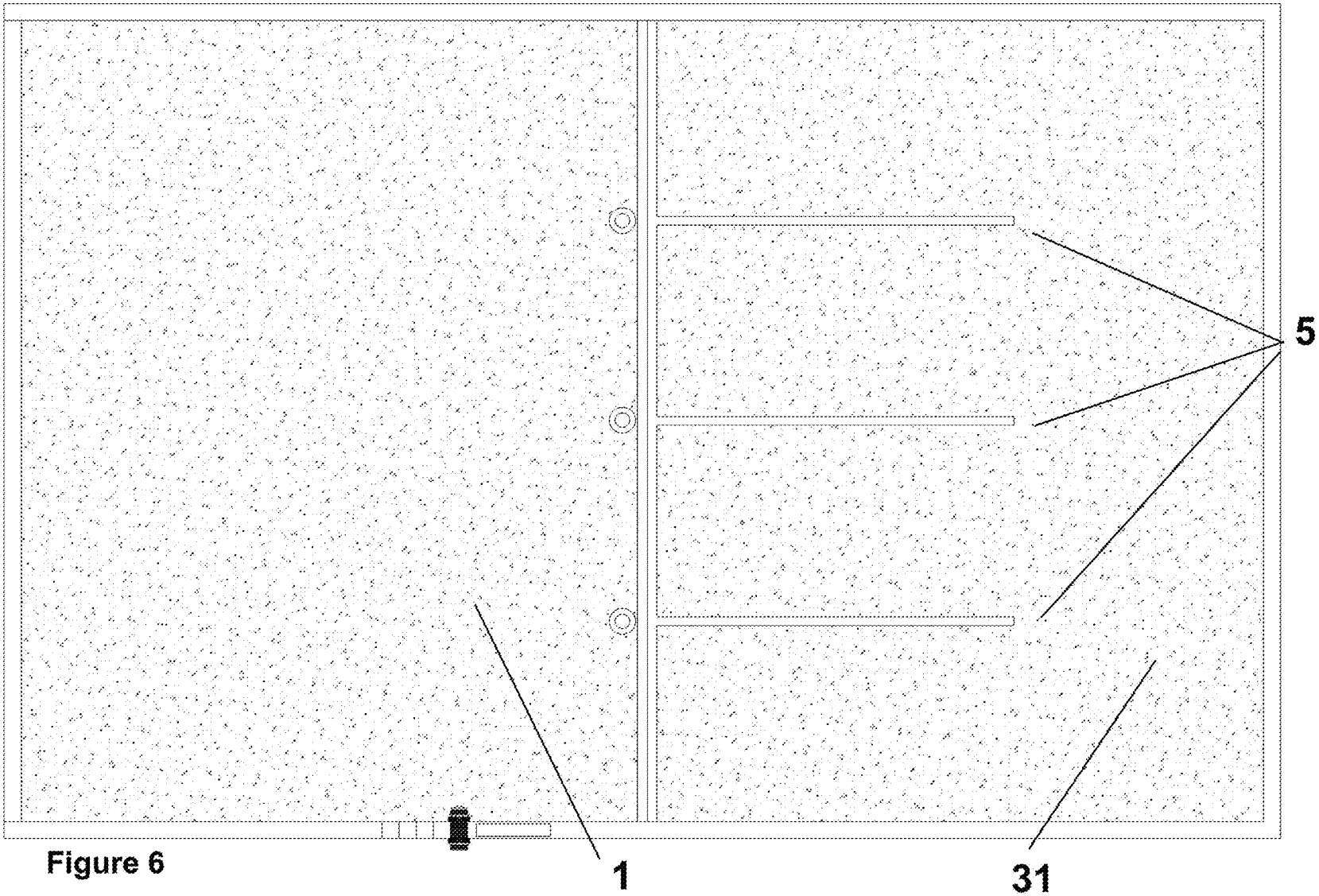
FIG. 6 is a top view of the direction options section of the hitting pad.

FIG. 6 is a top view of the direction options 5 section of the hitting pad.

Figure 7:
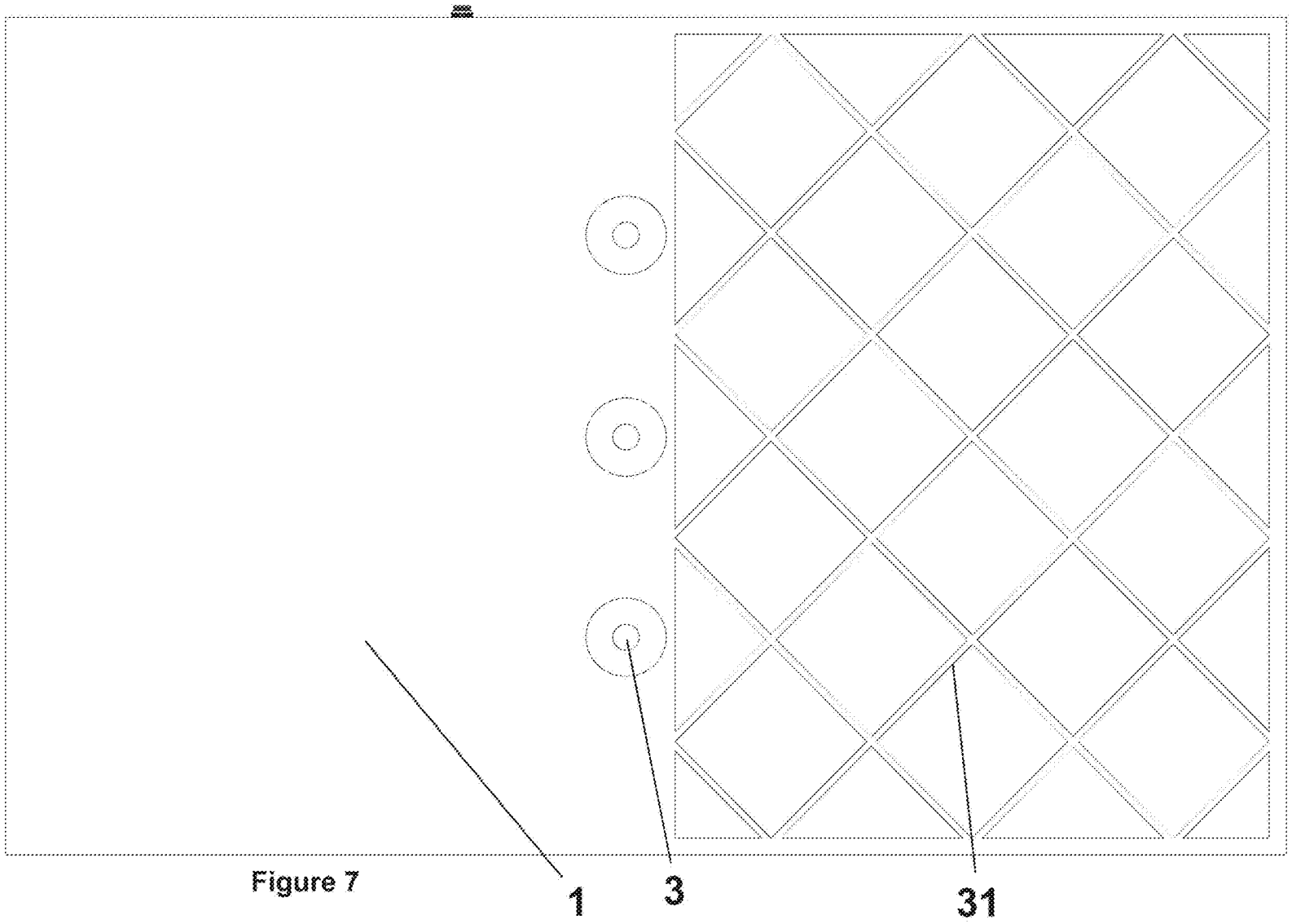
FIG. 7 is a bottom view of is a side view of the hitting pad portion of the invention.

FIG. 7 is a bottom view of is a side view of the hitting pad portion of the invention.

Figure 8:
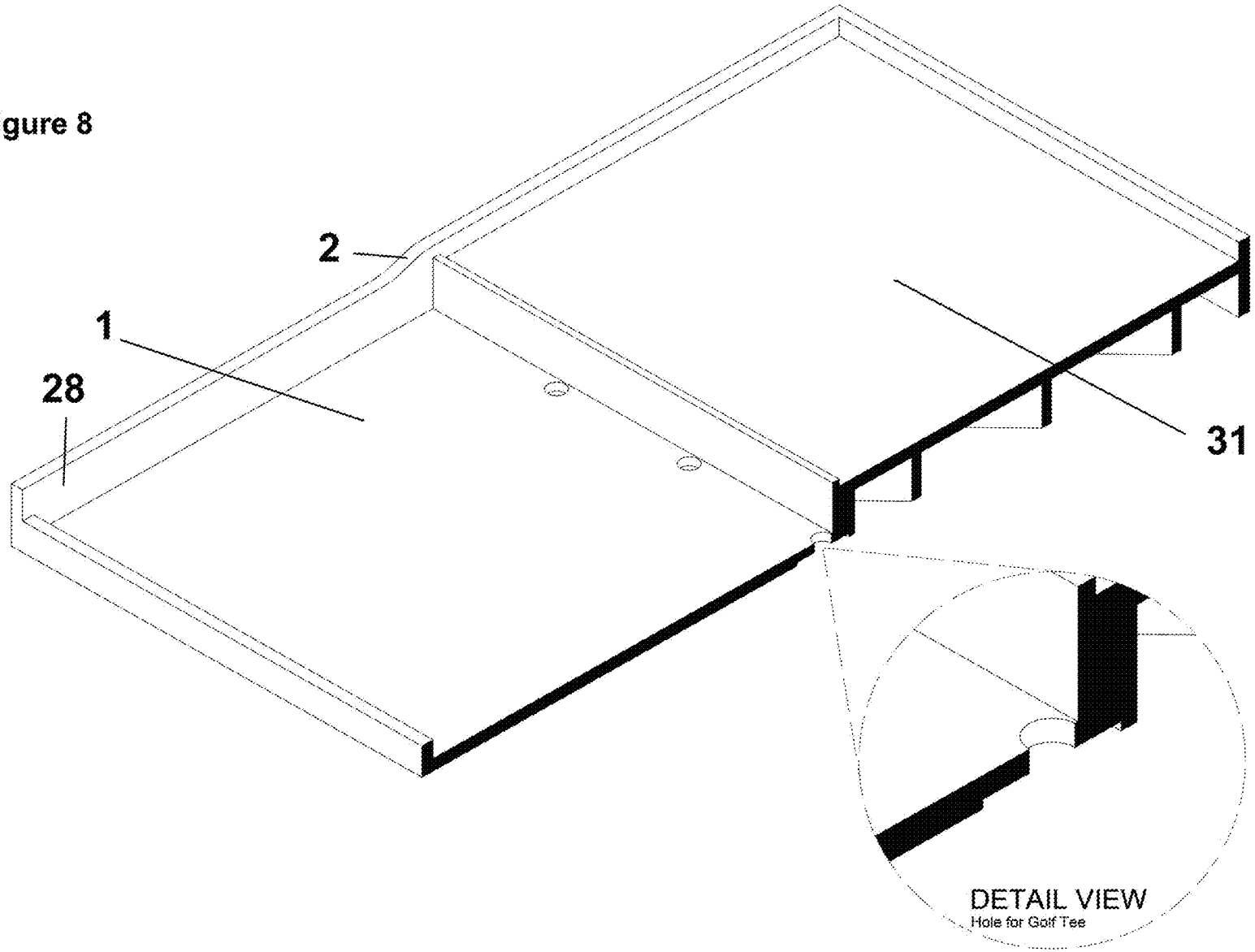
FIG. 8 is a side, perspective view the hitting pad portion of the invention.

FIG. 8 is a side, perspective view the hitting pad portion of the invention showing the rails 28 and step 2.

Figure 9:
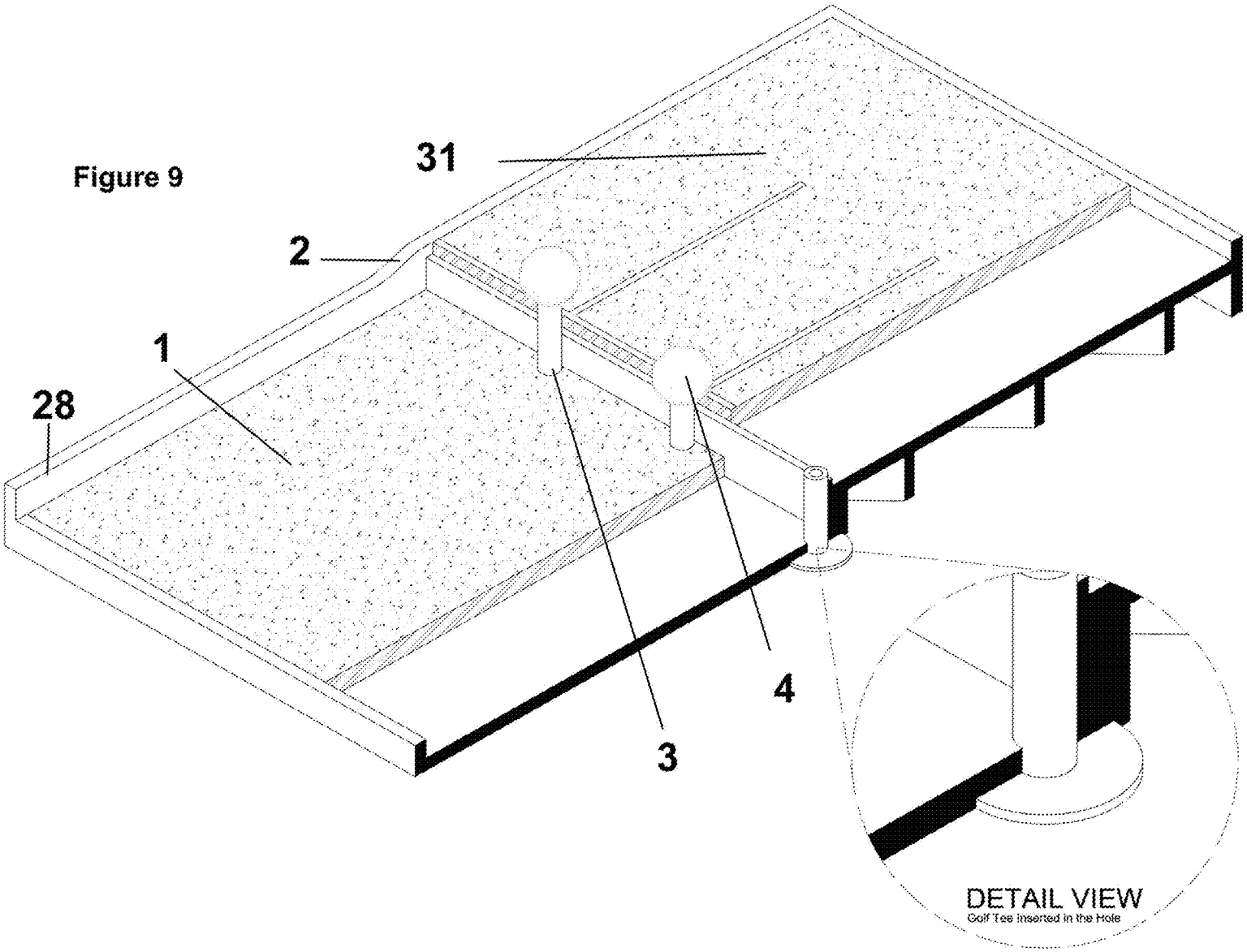
FIG. 9 is a side, perspective view the hitting pad portion of the invention.

FIG. 9 is a side, perspective view the hitting pad portion of the invention.

Figure 10:
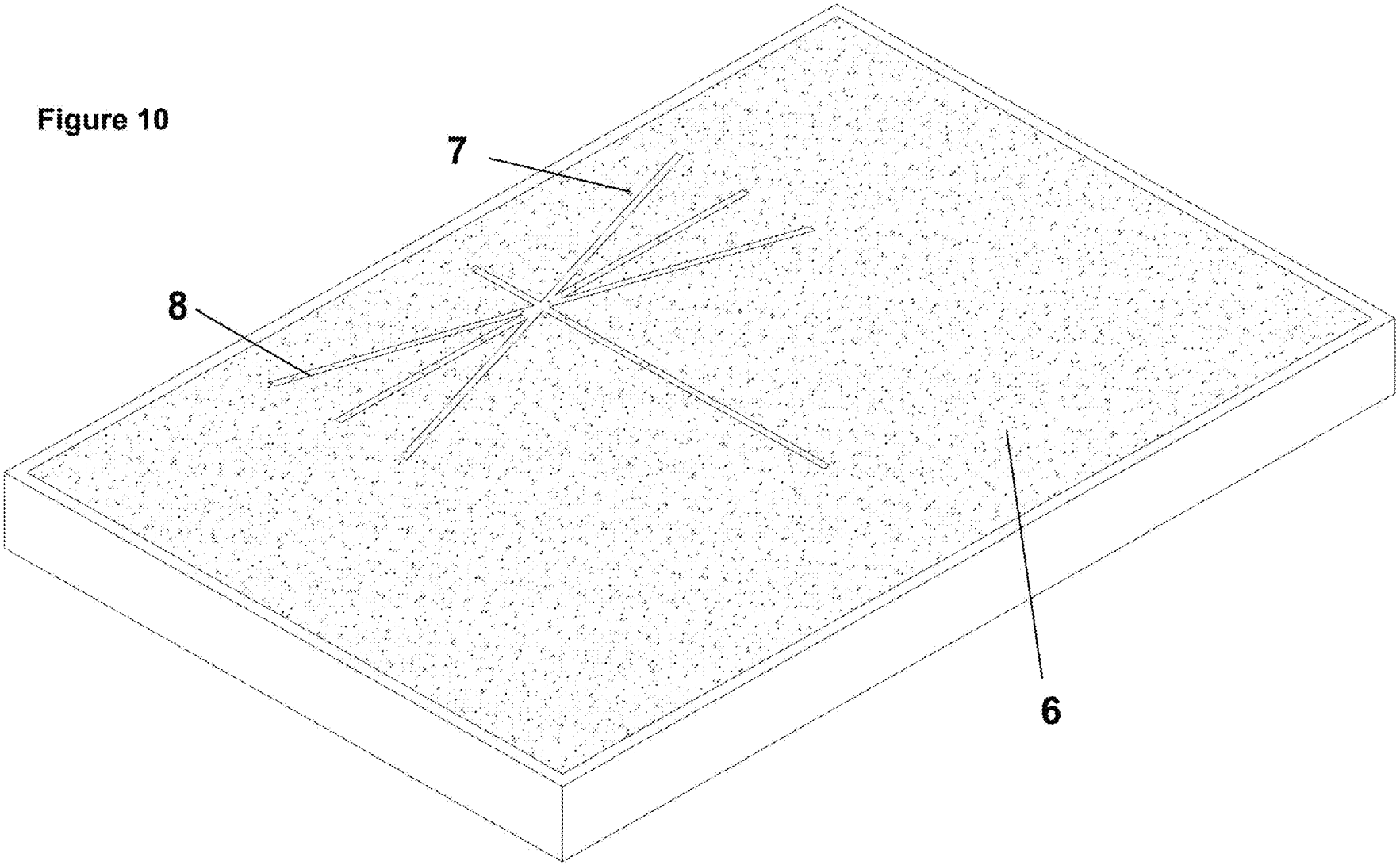
FIG. 10 is a perspective view of the standing pad portion of the invention.

FIG. 10 is a perspective view of the standing pad portion of the invention, showing the stand pad alignment lines 7 and the golf ball direction lines 8.

Figure 11:
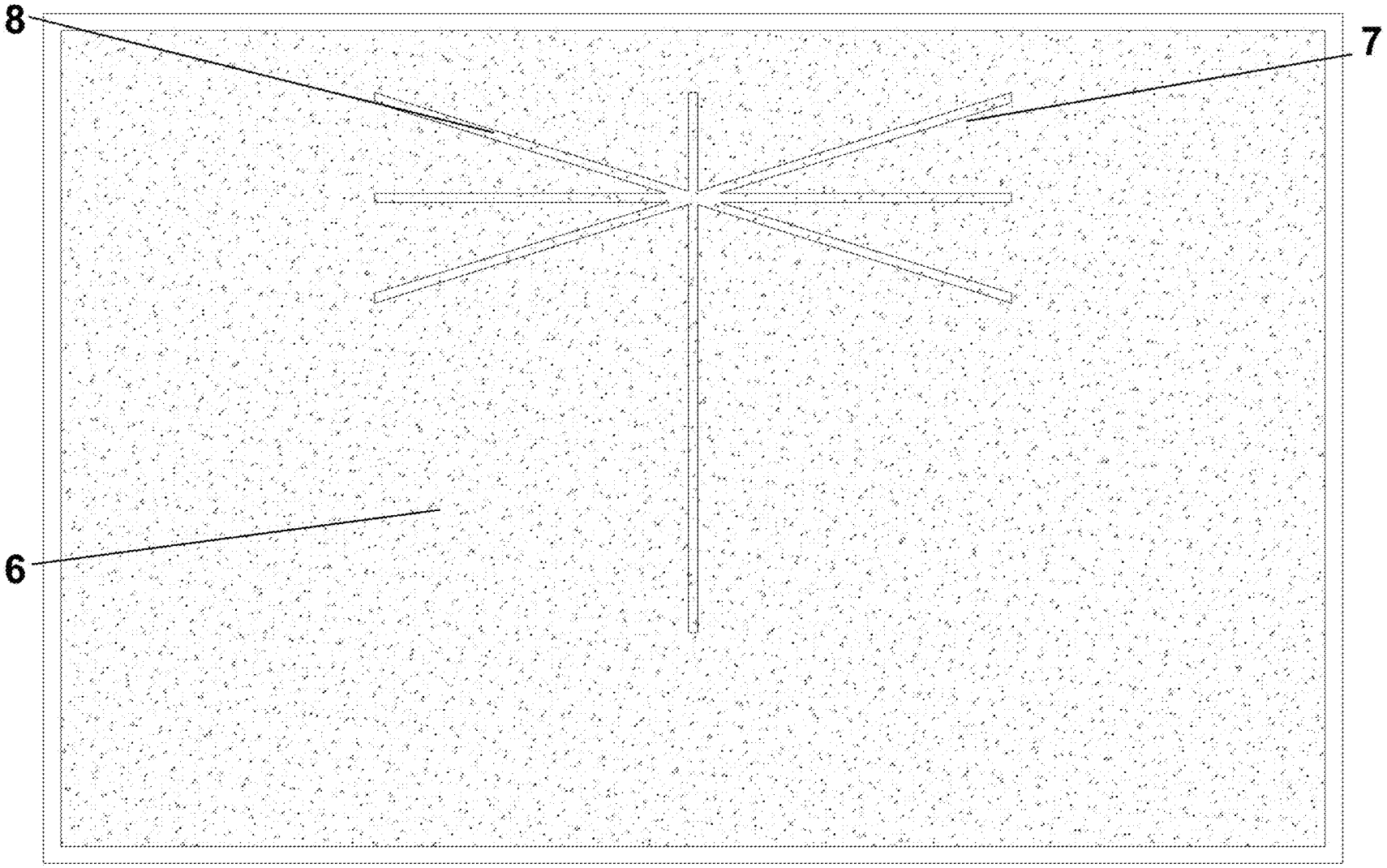
FIG. 11 is a perspective view of the standing pad portion of the invention.

FIG. 11 is a perspective view of the standing pad portion of the invention showing the stand pad alignment lines 7 and the golf ball direction lines 8.

Figure 12:
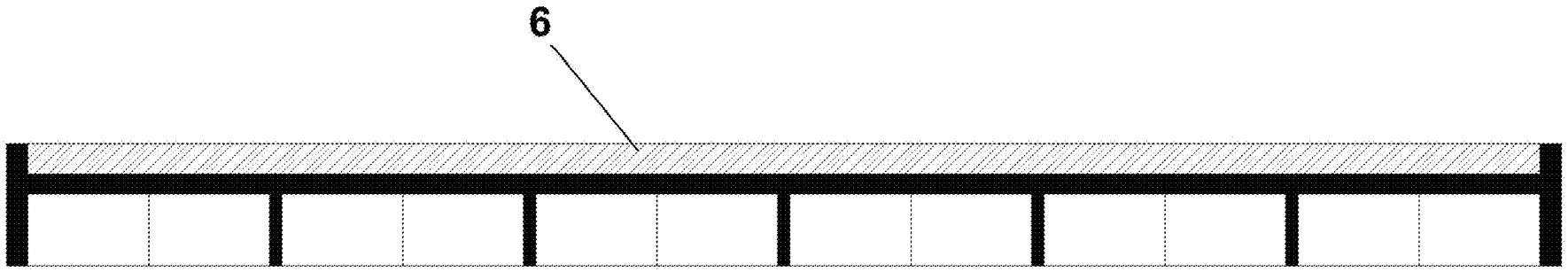
FIG. 12 is a side view of the standing pad portion of the invention.

FIG. 12 is a side view of the standing pad portion of the invention.

Figure 13:
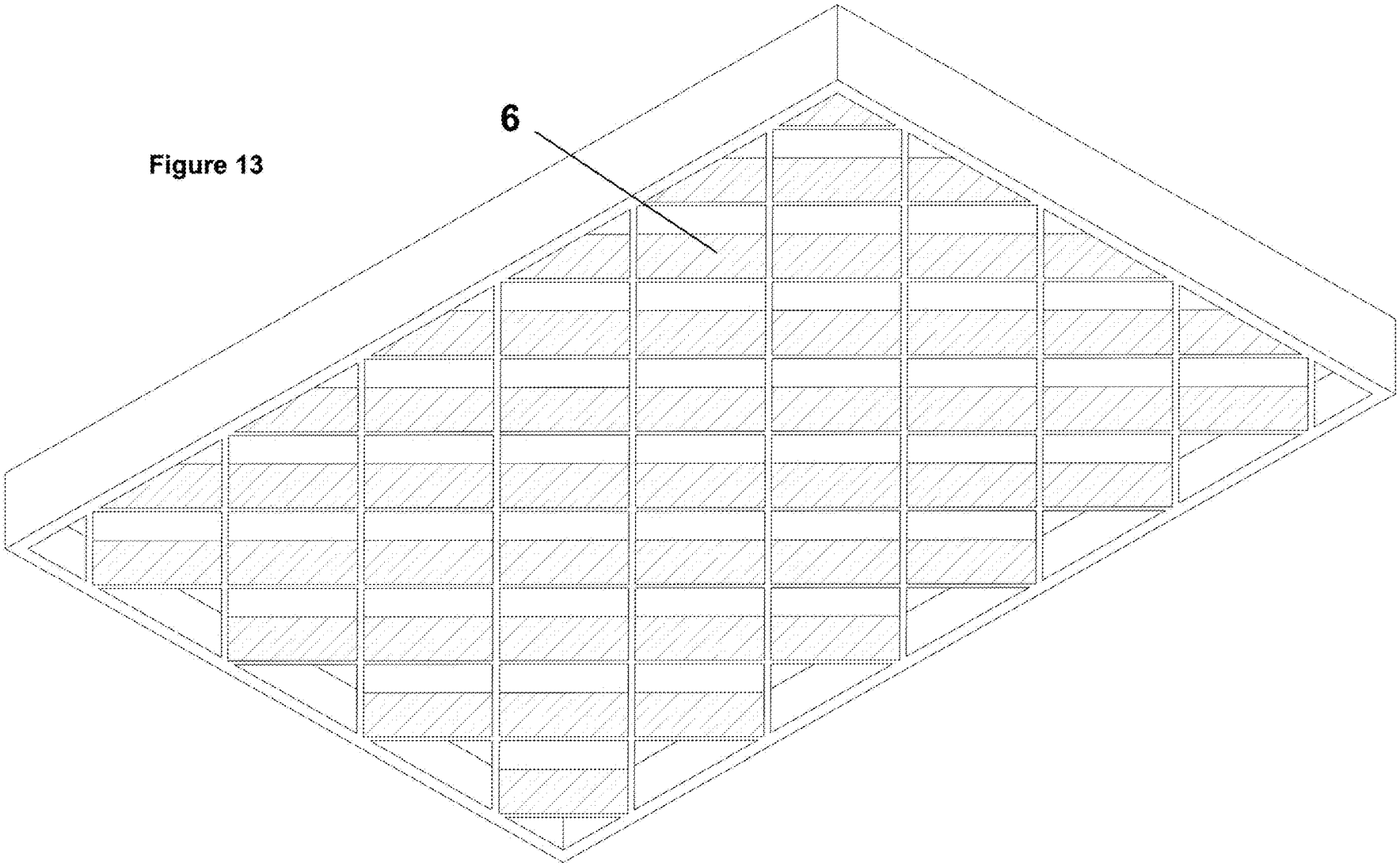
FIG. 13 is a bottom, perspective view of the standing pad portion of the invention.

FIG. 13 is a bottom, perspective view of the standing pad portion of the invention.

Figure 14:
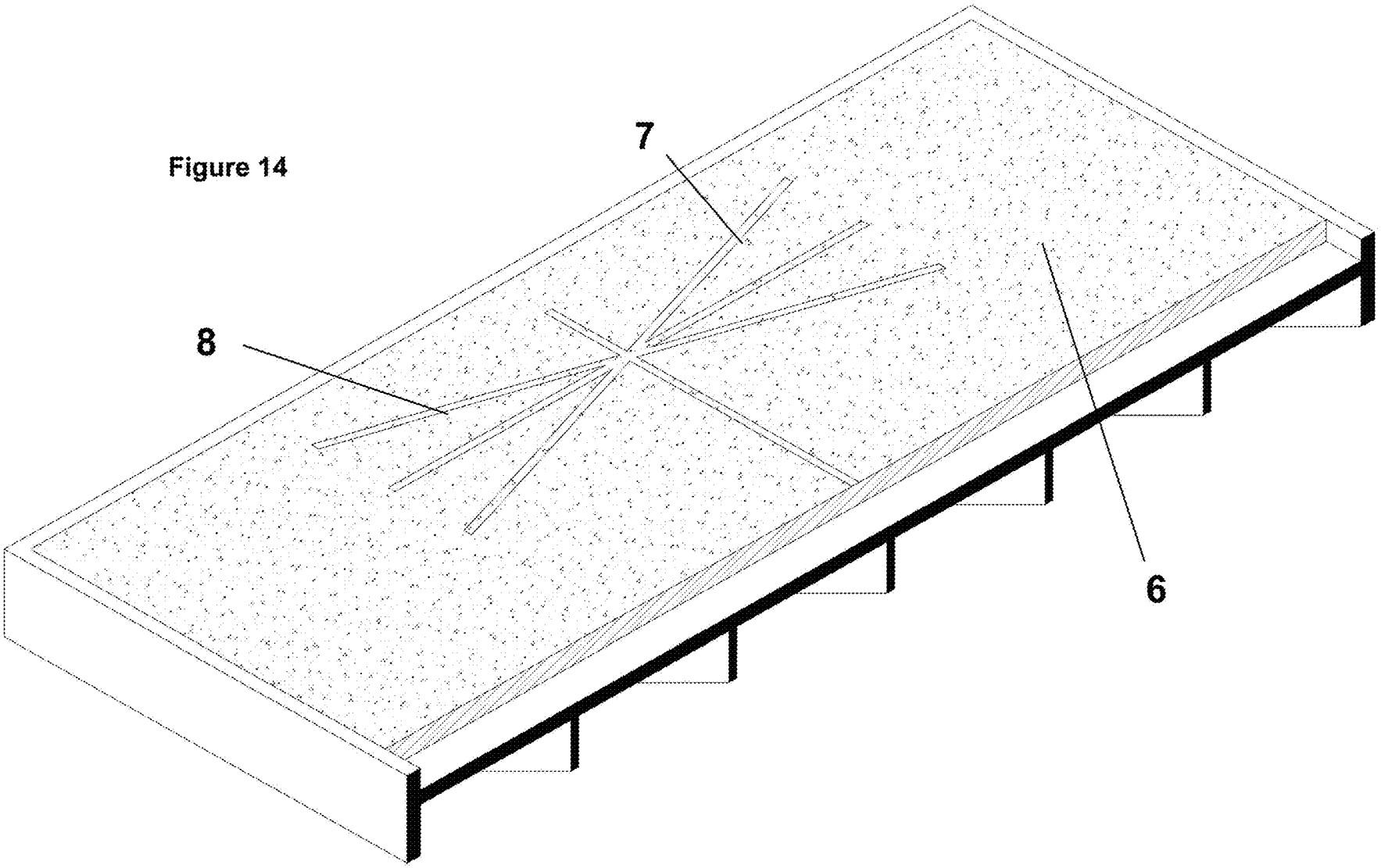
FIG. 14 is a top, perspective view of the standing pad portion of the invention.

FIG. 14 is a top, perspective view of the standing pad portion of the invention.

Figure 15:
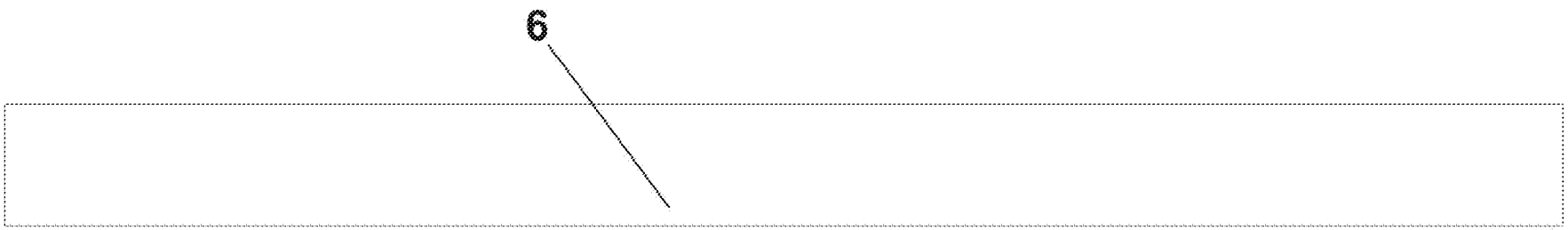
FIG. 15 is a back view of the standing pad portion of the invention.

FIG. 15 is a back view of the standing pad portion of the invention.

Figure 16:
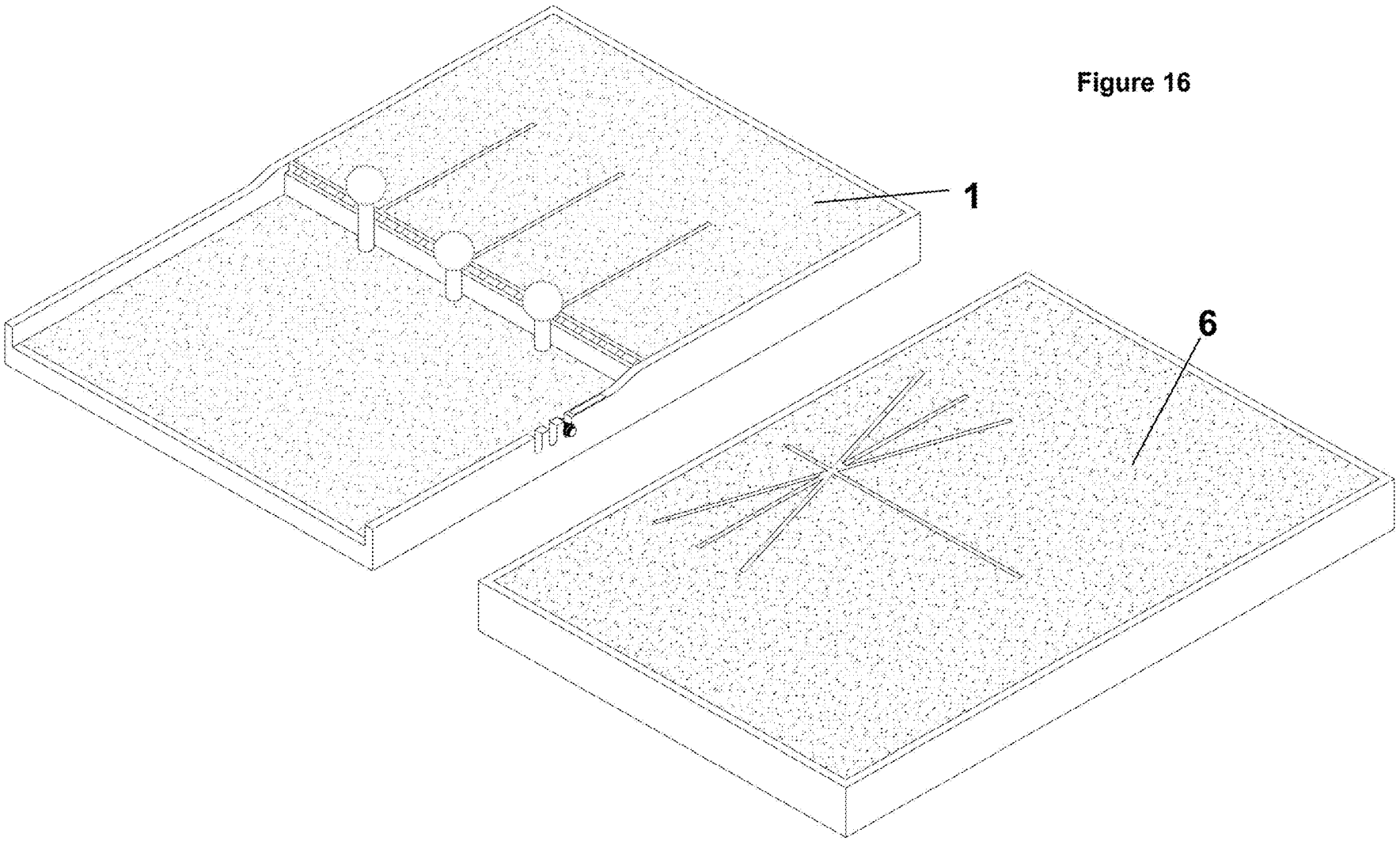
FIG. 16 is a perspective view of the standing portion and the hitting portion of the invention.

FIG. 16 is a perspective view of the standing portion 6 and the hitting portion 1 of the invention.

Figure 17:
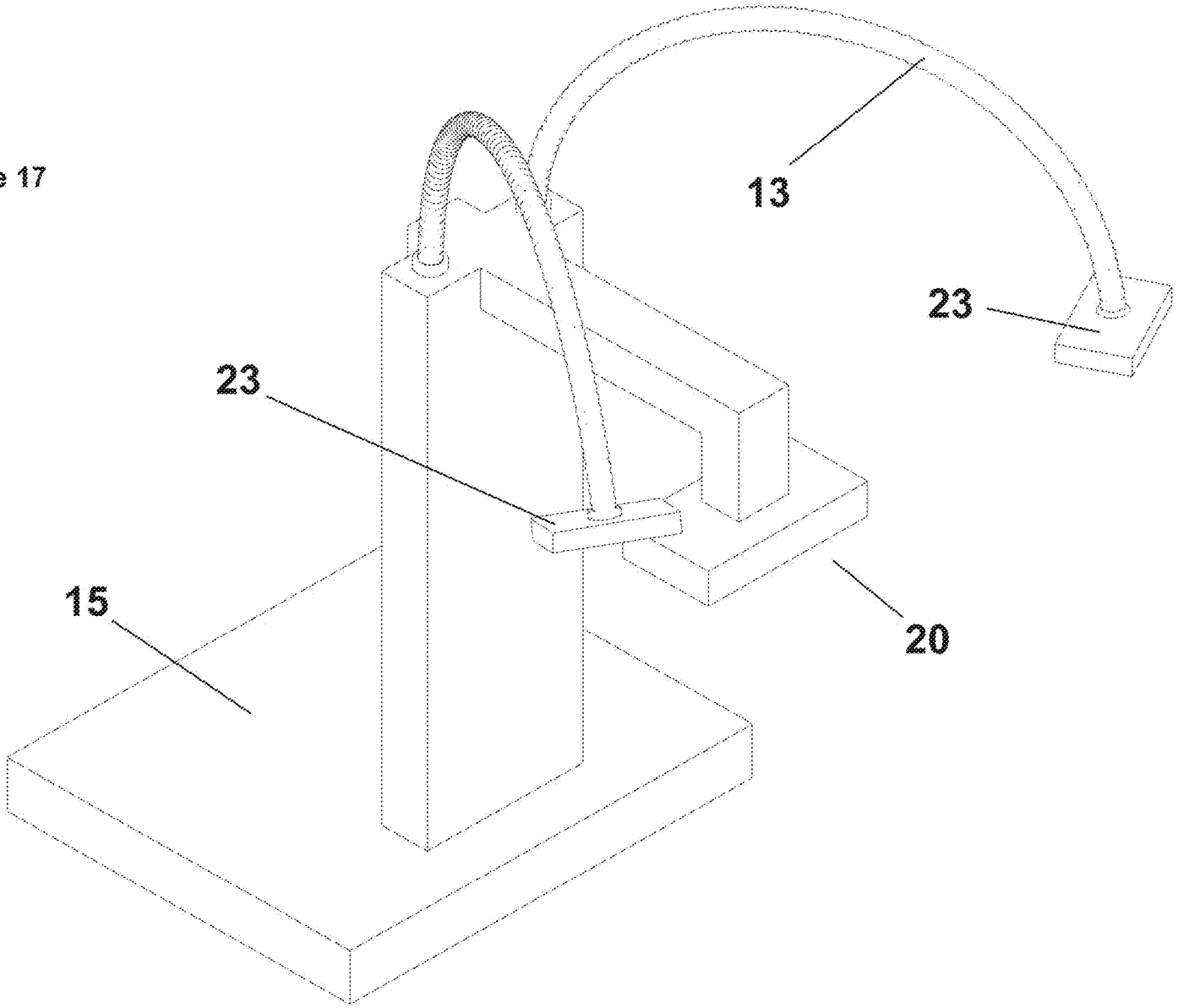
FIG. 17 is a perspective view of the light unit of the invention.

FIG. 17 is a perspective view of the light unit of the invention. A light support base 15 holds the lights in place. Flexible necks connect slow strobe lights 23 and/or motion detectors. A strobe light is located in a fixed arm 20 over the ball.

Figure 18:
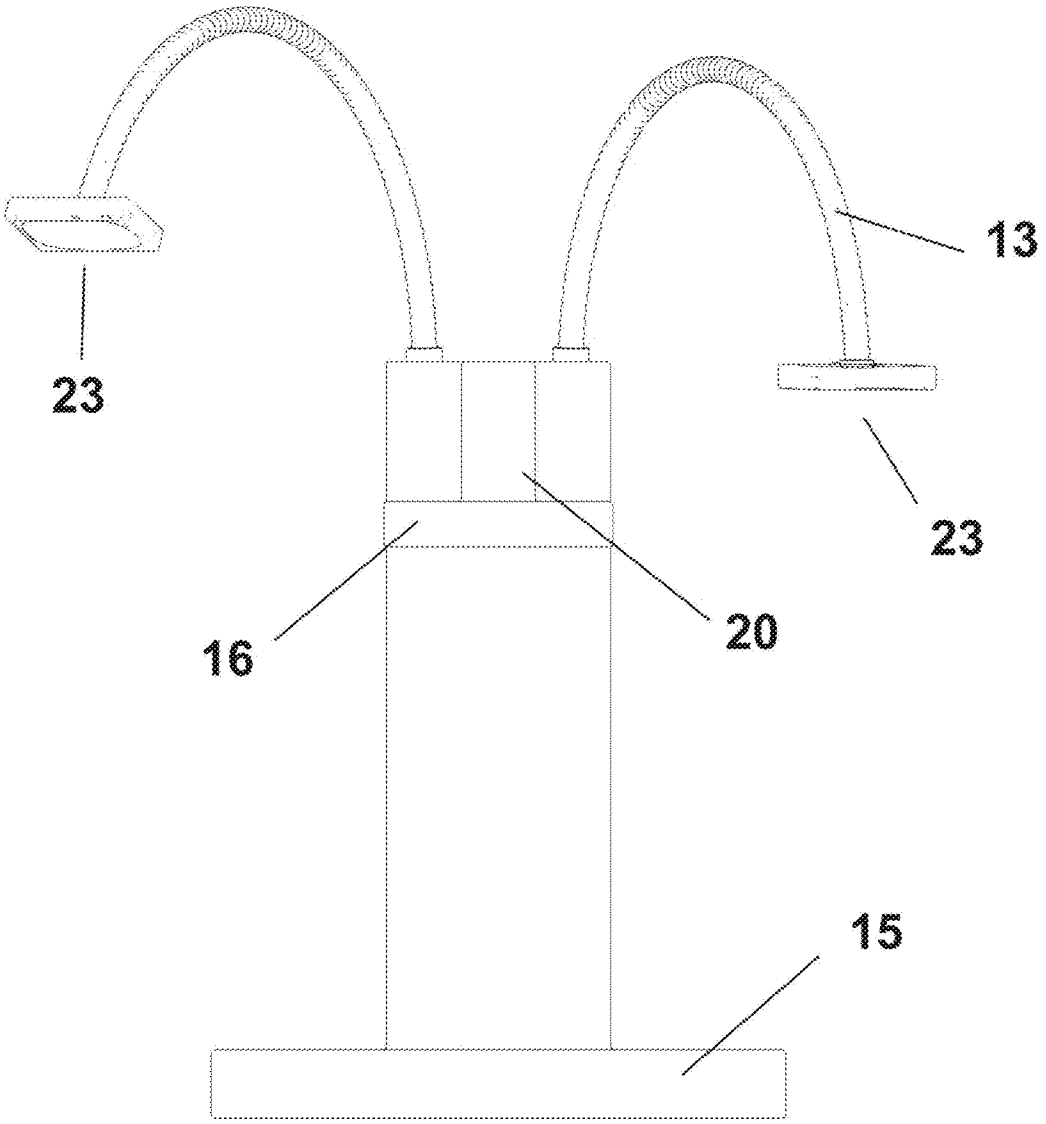
FIG. 18 is a front view of the light unit of the invention.

FIG. 18 is a front view of the light unit of the invention.

Figure 19:
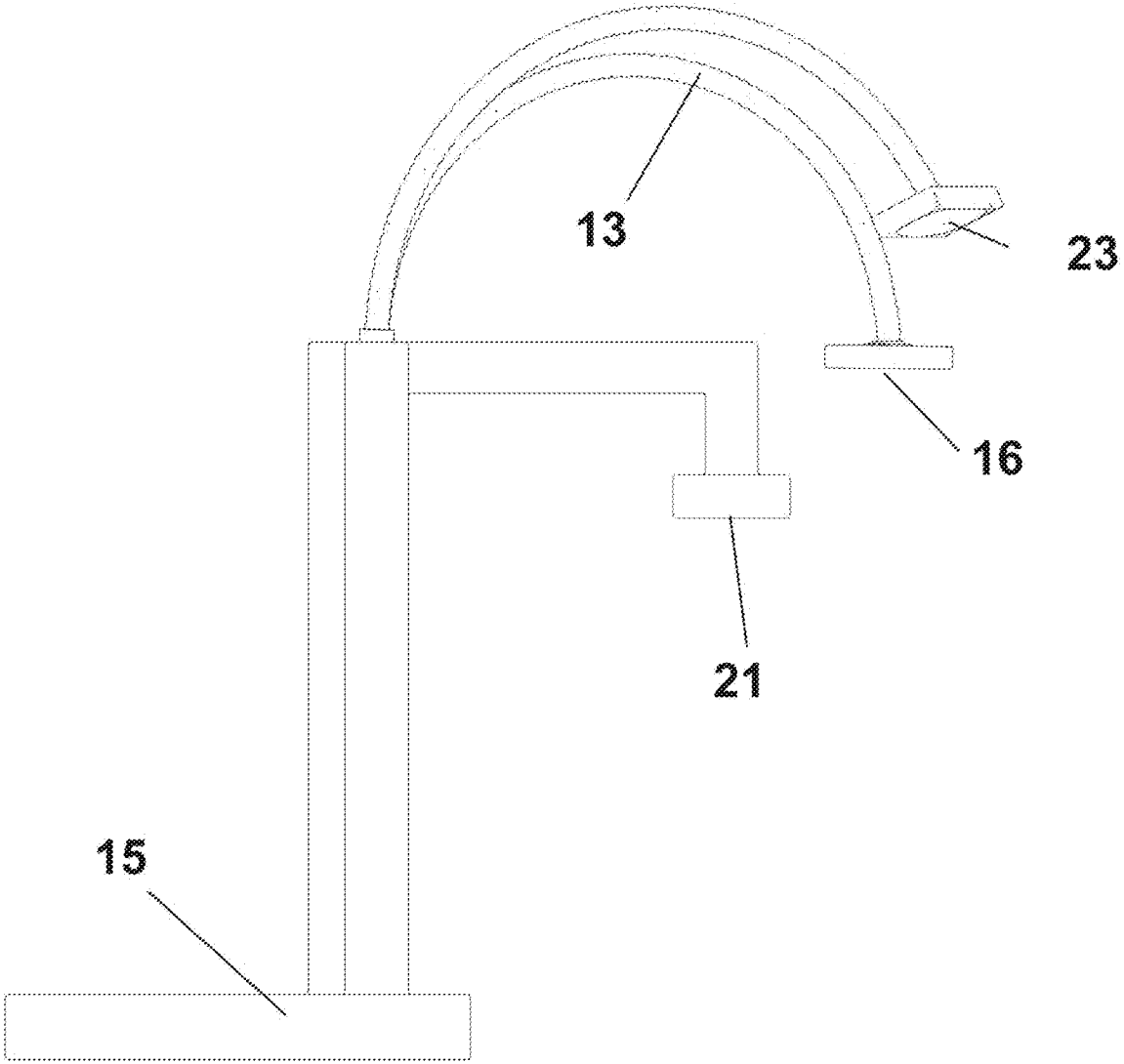
FIG. 19 is a side view of the light unit of the invention.

FIG. 19 is a side view of the light unit of the invention with, in this embodiment, a light and motion sensor 16 located at the end of a flexible neck 13, and a motion detector 21 located in an arm off the base.

Figure 20:
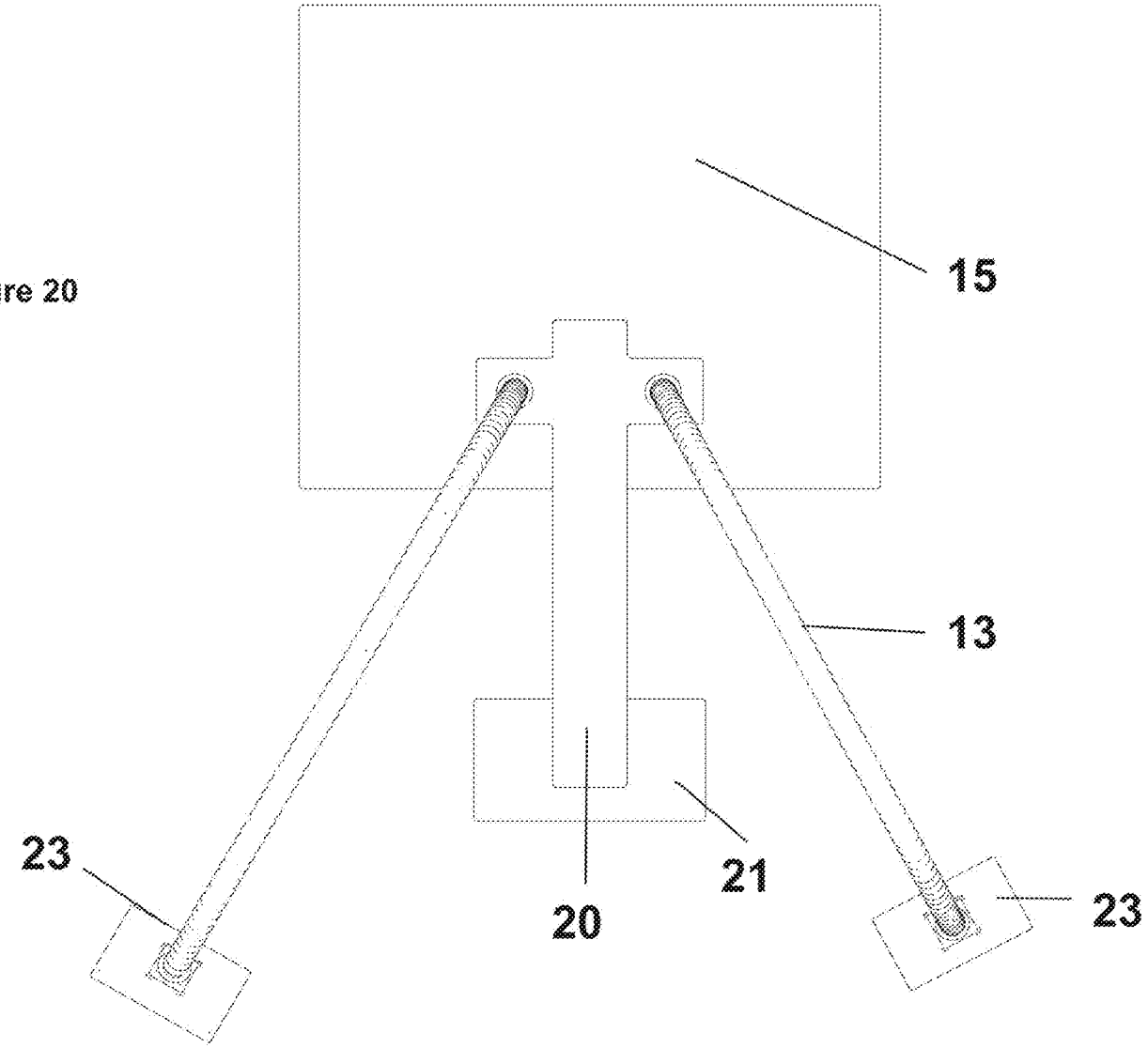
FIG. 20 is a top view of the light unit of the invention.

FIG. 20 is a top view of the light unit of the invention.

Figure 21:
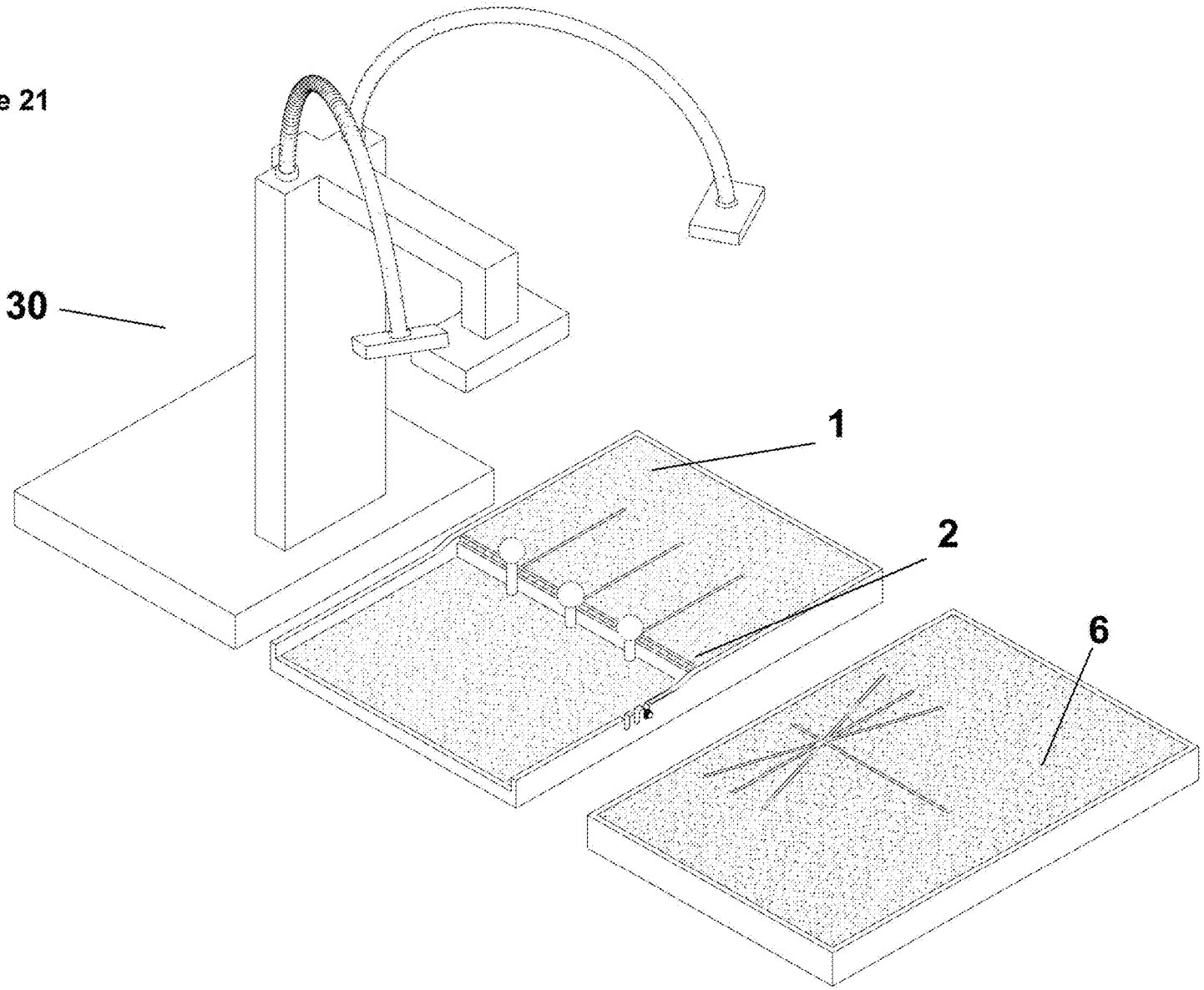
FIG. 21 is a perspective view of the light unit, the hitting pad and the standing pad lined up ready for use.

FIG. 21 is a perspective view of the light unit 30, the hitting pad 1 and the standing pad 6 lined up ready for use.

To summarize the invention, the hitting pad has a step that delineates a raised and a lowered portion, to decrease the chances of injury to the golfer during a downward stroke. An adjustable tee holds a golf ball. A series of hitting pad adjustment reference lines allow golfers to correctly direct their swing. A series of standing pad alignment reference lines identify golf ball direction options for right- and left-handed golfers to achieve different golf shots. A display provides visual display of calculations from an internal calculator or mini-computer that provides calculations based on various types of feedback from the invention. The light support base is connected to the base, and a flexible neck has a strobe light at its end. At the base of the light support base is a speed meter, that measures the speed of the golf club as it passes. Depending on whether the user is right- or left-handed, the speed meter can rotate to the right or left. The speed meter measures the speed of a passing golf club. This data is fed into the calculator or mini-computer, which then displays the results on the display. On the end of the light support base is a fast strobe light and a motion detector. At the end of the flexible arm is a second motion detector and a slow strobe light. When a golf club passed through the invention, the motion detector detects the movement and triggers the slow strobe light to flash. At the same time, the movement of the golf club triggers the second motion detector to trigger the fast strobe light to flash. Since the golfer's eye are (or at least should be) on the ball, these strobe light flashes show the golfer exactly what the angle of the club is to the ball. It should be noted that the flexible arm is one embodiment, and is not intended to limit the scope of the invention.

The display digitally shows the results of each golf swing in a visual display of calculations. The flexible neck can be adjusted to be pointed in the direction of the golf club, to show the trajectory of the golf club head. The light support base is fixed in place in this embodiment and holds the motion detector and the fast strobe light which shows the position of the golf club head as it impacts the golf ball. This allows the user to instantly see whether the golf club head hit the ball squarely, or was angled to one side or the other. Two indicators—W and I—can be selected to measure distance according to whether the user is swinging a wood or iron club.

The rotating speed meter lens, which can be adjusted to the right for right-handed golfers, and to the left for left-handed golfers. The light support base in this embodiment, can be adjusted higher or lower so that the golfer does not hit it with his or her swing. The speed meter in this embodiment can be rotated left or right to accommodate both right- and left-handed golfers.

A golf club is swung to impact a golf ball on an adjustable tee, located on the hitting pad. A speed meter measures the velocity of the club head as it passed through the speed meter's detection zone. The strobe light flashes, when triggered by the motion detector, and presents an image of the golf club head striking the golf ball. This image shows if the golfer's swing is directly aligned with the desired direction of the ball, or if it is off-angle.

In one embodiment, there is a fast strobe light on the end of the light support base along with a second motion detector. At the end of the flexible arm are a first motion detector and a slower strobe light. Thus, as the head of the golf club strikes the golf ball, the first motion detector triggers the fast strobe light to take a "snapshot" of the angle of the golf club striking the golf ball, while the second motion detector triggers the slow strobe light to take a "longer" picture to show the swing angle that the golfer has taken. The flexible arm detects a "first motion" with the slow light and shows the trajectory of the swing. The fixed arm detects a "second motion" with the fast strobe light that shows the position of the golf club at the point of impact. This second embodiment the invention gives the golfer feedback not only on the speed of the swing and the distance the ball will travel, but also on the general path of the swing and the exact alignment of the face of the golf club on the golf ball.

Furthermore, those skilled in the art can appreciate that the above description does not provide specific details of the manufacture or design of the various components. Those of skill in the art are familiar with such details, and unless departures from those techniques are set out, techniques, known, related art or later developed designs and materials should be employed. Those in the art can choose suitable manufacturing and design details.

Further, the terminology used herein is for the purpose of describing particular embodiments only and is not intended to be limiting of the disclosure. It will be appreciated that several of the above-disclosed and other features and functions, or alternatives thereof, may be combined into other systems or applications. Various presently unforeseen or unanticipated alternatives, modifications, variations, or improvements therein may subsequently be made by those skilled in the art without departing from the scope of the present disclosure as encompassed by the following claims.

It will be appreciated that variants of the above-disclosed and other features and functions, or alternatives thereof, may be combined into many other different systems or applications. Various presently unforeseen or unanticipated alternatives, modifications, variations, or improvements therein may be subsequently made by those skilled in the art which are also intended to be encompassed by the following claims.

What is claimed is:

1. A device for improving a golfer's swing, consisting of:
a hitting pad,
a standing pad,
and a light unit,
where a golfer stands on the standing pad, uses a golf club to hit a golf ball on the hitting pad, and where the light unit detects a speed at which the golf club was swung, and a distance and a direction the golf ball would be hit based on the speed and an angle measured by a movement detection portion of the light unit, where the light unit has a flat and rectangular base, upon which a display is mounted, and inside of which a calculator or mini-computer is located, additionally comprising a light support base, where the light support base contains a strobe light, a motion detector and a speed meter, where the speed meter measures the golf club's velocity, the motion detector detects movement of the golf club and triggers the strobe light to flash at a moment at which the golf club strikes the golf ball, thereby illuminating an angle at which a head of the golf club strikes the ball in an image visible to the user of the invention, where the light support base additionally comprises a flexible neck, where the flexible neck has a second motion detector and a slow strobe located at a flexible neck end, where the second motion detector also detects the movement of the golf club and triggers the slow strobe, which illuminates a path that the golf club takes while moving toward the golf ball, creating a second image visible to the user of the invention.

2. The device of claim 1, where a person using the invention detects both a strike angle and an approach angle through viewing the image and the second image.

3. The device of claim 1, where the light support base has a flexible joint.

4. The device of claim 1, where the display takes one or more data items from the computer and displays the one or more data items on a screen of the display, providing a visual display of calculations, where the visual display of calculations includes the distance and speed a golf swing would send a golf ball.

5. The device of claim 1, where the hitting pad is a flat, rectangular shaped hitting pad with a step separating a raised portion from a lowered portion, additionally comprising a tee.

6. The device of claim 5, where the tee is adjustable.

7. The device of claim 5, additionally comprising one or more hitting pad alignment reference lines.

8. The device of claim 1, where the standing pad is a flat, rectangular standing pad.

9. The device of claim 8, where the standing pad has one or more standing pad alignment reference lines.

10. The device of claim 8, where the standing pad has one or more golf ball direction options.

11. The device of claim 3, where the standing pad has one or more foot placement guides.

12. The device of claim 1, where the light unit has a flat and rectangular base, upon which a display is mounted, and inside of which a calculator or mini-computer is located.

13. The device of claim 12, additionally comprising a light support base.

14. The device of claim 13, where the light support base contains a strobe light, a motion detector and a speed meter, where the speed meter measures the golf club's velocity, the motion detector detects movement of the golf club and triggers the strobe light to flash at a moment at which the golf club strikes the golf ball, thereby illuminating an angle at which a head of the golf club strikes the ball in an image visible to the user of the invention.

15. The device of claim 13, where the light support base additionally comprises a flexible neck, where the flexible neck has a second motion detector and a slow strobe located at a flexible neck end, where the second motion detector also detects the movement of the golf club and triggers the slow strobe, which illuminates a path that the golf club takes while moving toward the golf ball, creating a second image visible to the user of the invention.

16. A device for improving a golfer's swing, consisting of:

a hitting pad, a standing pad, and a light unit, where a golfer stands on the standing pad, uses a golf club to hit a golf ball on the hitting pad, and where the light unit detects a speed at which the golf club was swung, and a distance and a direction the golf ball would be hit based on the speed and an angle measured by a movement detection portion of the light unit, where the hitting pad has a lower portion and an upper portion, where the lower portion and the upper portion are separated by a step, with the step additionally comprises two or more adjustable tees, wherein the standing pad additionally comprises two or more standing pad alignment reference lines and two or more golf ball direction options, wherein the hitting pad additionally comprises two or more golf ball direction lines, where a golfer stands on the standing pad, uses a golf club to hit a golf ball on the hitting pad, and where the light unit detects a speed at which the golf club was swung, and a distance and a direction the golf ball would be hit based on the speed and an angle measured by a movement detection portion of the light unit, where the hitting pad is a flat, rectangular shaped hitting pad with a step separating a raised portion from a lowered portion, additionally comprising a tee, where the tee is adjustable, additionally comprising one or more hitting pad alignment reference lines, where the standing pad has one or more golf ball direction options, where the standing pad has one or more foot placement guides, where the light unit has a flat and rectangular base, upon which a display is mounted, and inside of which a calculator or mini-computer is located, where a light support base contains a strobe light, a motion detector and a speed meter where the speed meter measures the golf club's velocity, the motion detector detects movement of the golf club and triggers the strobe light to flash at a moment at which the golf club strikes the golf ball, thereby illuminating an angle at which a head of the golf club strikes the ball in an image visible to the user of the invention, where the light support base additionally comprises a flexible neck, where the flexible neck has a second motion detector and a slow strobe located at a flexible neck end, where the second motion detector also detects the movement of the golf club and triggers the slow strobe, which illuminates a path that the golf club takes while moving toward the golf ball, creating a second image visible to the user of the invention, where a person using the invention detects both a strike angle and an approach angle through viewing the image and the second image.

* * * * *